United States Patent [19]

Miller

[11] Patent Number: 4,949,490

[45] Date of Patent: Aug. 21, 1990

[54] REINFORCED PANEL DEVICE

[75] Inventor: Melvin M. Miller, Bloomington, Ind.

[73] Assignee: Channel-Kor Systems, Inc., Bloomington, Ind.

[21] Appl. No.: 908,229

[22] Filed: Sep. 17, 1986

[51] Int. Cl.[5] ..... G09F 7/00

[52] U.S. Cl. ..... 40/605; 40/610; 160/135

[58] Field of Search ..... 181/30; 273/23 A, 127 B; 160/135, 182, 183, 229.1, 234; 40/610, 605, 639; 211/189

[56] References Cited

U.S. PATENT DOCUMENTS

| | | | |
|---|---|---|---|
| 2,827,295 | 3/1958 | Austin | 273/26 A |
| 3,232,370 | 2/1966 | Jaffe | 160/135 |
| 3,319,801 | 5/1967 | Nordstrom | 160/135 |
| 3,408,071 | 10/1968 | Lundy | 273/26 A |
| 3,608,221 | 9/1971 | Harris | 40/610 |
| 3,630,309 | 12/1971 | Wenger | 160/135 |
| 3,685,666 | 8/1972 | Rose | 40/610 |
| 3,695,330 | 10/1972 | Hasbrouck | 160/135 |
| 3,817,396 | 6/1974 | Markson | 40/605 |
| 4,072,295 | 2/1978 | Roberts | 256/26 |
| 4,112,604 | 9/1978 | Ott et al. | 40/610 |
| 4,194,313 | 3/1980 | Downing | 40/610 |
| 4,228,842 | 10/1980 | Clark | 160/229.1 |
| 4,241,777 | 12/1980 | Wenger | 160/135 |
| 4,278,145 | 7/1981 | Eade et al. | 40/606 |
| 4,403,554 | 9/1983 | Valentine et al. | 211/189 |
| 4,545,142 | 10/1985 | Whisnant | 40/605 |
| 4,610,560 | 9/1986 | Miller | 160/229.1 |

FOREIGN PATENT DOCUMENTS

| | | | |
|---|---|---|---|
| 1812442 | 6/1970 | Fed. Rep. of Germany | 160/135 |
| 2110404 | 12/1979 | Fed. Rep. of Germany | 40/610 |

*Primary Examiner*—James T. McCall
*Assistant Examiner*—J. R. Hakomaki
*Attorney, Agent, or Firm*—Donald R. Bahr

[57] ABSTRACT

This invention is concerned with a reinforced panel device which is useful in the display and furniture arts. The reinforced panel device consist of a base and a header. By placement of the header on the base the various panel sections which make up the base are locked into a plumar relationship with each other. the base section of the reinforced panel device comprises a plurality of panel sections which are pivotly connected to each other. The header may comprise a single panel section or a plurality of panel sections which are pivotly connected to each other. The header may be permanently or detachably attached to the base. In accordance with the preferred embodiment the header is attached to the base via a connector plug having a camming end and a hook end.

14 Claims, 2 Drawing Sheets

REINFORCED PANEL DEVICE

This invention is concerned with portable, flexible panel devices which can be used to display information at trade shows and conventions. The panel device of this invention is also useful in the furniture arts. Panel devices as may be used at trade shows or conventions are of two principle types, these being the large bulky type and the portable type. This invention is concerned with the portable type of display device. The portable display devices have become very popular in recent years for utilization at regional trade shows and conventions. These portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled and disassembled only with great difficulty by extra workmen at great expense.

The subject invention is useful in connection with portable panel devices wherein a plurality of display panels or display sections are attached to each other and the composite structure functions as a panel device. It is often desirable to locate the panel sections of a panel device in a planar relationship with each other. It is in this area where the subject invention is useful. In accordance with this invention panel sections of the panel device of this invention can be located in a planar relationship with each other and then locked into a reinforced relationship with each other. This invention also includes an angular header system which locks the individual sections of the panel device in fixed relationship with each other. Further the invention encompasses a means whereby the angular header can be attached to the panel device.

In the panel device of this invention the individual panel sections are connected to each other via a plurality of hinges. A wide variety of hinges may be used including the hinge system and related vertical supports as are illustrated in copending application Ser. No. 801,304 filed Nov. 25, 1985.

The prior art panel devices are troublesome in that when a large planer surface is formed from a plurality panel sections the sections are not locked into relationship with each other. As a result of this non locking relationship of the individual panel sections the overall panel device tends to be unstable. Due to this instability the overall panel device tends to present a flimsy appearance.

In contrast to these problems the reinfored panel device of this invention which incorporates an angular header locks up into a reinforced composite structure which presents a stable appearance.

DESCRIPTION OF THE PREFERRED EMBODIMENT

The subject invention relates to a panel device which comprises a plurality of panels sections which are secured in parallel relationship with each other with a plurality of hinges. In accordance with a preferred embodiment the panel device incorporates a plurality of vertical supports which are connected to each other by hinges. Spaced between the vertical supports are panel sections. The parallel relationship of the vertical supports may be further defined by interconnecting horizontal supports. The combination of the vertical supports and horizontal supports define a frame which may be square or rectangular. Secured within each frame so defined is a panel. The panel device of this invention is locked into a stable reinforced structure by the use of an angular header.

As is mentioned herein above the subject reinforced panel device is particularly useful in the portable display art. It should be noted however that the panel device of this invention is also useful in the furniture art. The subject panel device can be fabricated in such a size that it can be used for example as a room divider, office separator, privacy screen or noise barrier. In the furniture arts the panel device at hand is particularly useful in that the various panels can be angularly disposed in relation to each other to define and given surface area. In accordance with this invention the panel section can be locked into a reinforced relationship with each other.

Figure 1:
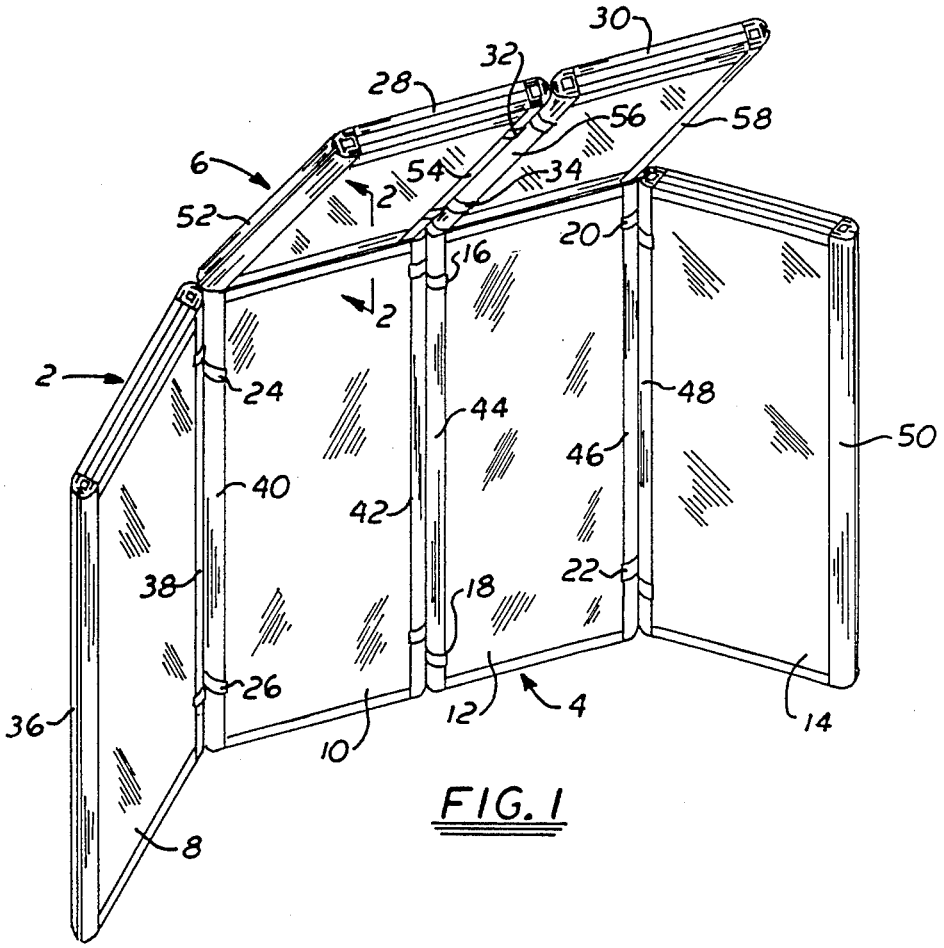
FIG. 1 is a perspective view showing the reinforced panel device of this invention.

Referring to FIG. 1 it can be seen that the reinforced panel device of this invention 2 comprises a base section 4 and, a header section 6.

As is shown in FIG. 1 base section 4 consist of a plurality of panels 8, 10, 12, and 14 which are pivotly connected to each other via a plurality of hinge elements 16, 18, 20, 22, 24 and 26. These hinge elements cooperate with and grip the panel the panel sections in a manner which will be described herein below.

Header section 6 likewise consist of a plurality of panel sections 28 and 30 which are pivotly connected to each other by hinges 32 and 34.

Referring to both base sections 4 and header section 6 only a limited number of panel sections are shown in FIG. 1. It is understood by one skilled in the art that additional panels can be incorporated into both base section 4 and header 6. Both base section 4 and header section 6 can incorporate any convenient number of panels sections in order that the resulting reinforce panel device is of the proper size.

As was mentioned above the individual panel sections of both the base section and the header section are pivotly connected to each other via a plurality of hinges. Many types of hinges can be used in accordance with this invention. In accordance with the preferred embodiment of this invention the hinges which are used to pivotly connect the various panel sections together are double hinges such as are illustrated in U.S. Pat. Nos. 3,341,180, 3,501,800, 4,163,303, 3,695,330 and U.S. application Ser. No. 801,304 filed Nov. 25, 1985.

In the structure as is illustrated in FIG. 1 the panel section of base section 4 are supported by a plurality of vertical supports 36, 38, 40, 42, 44, 46, 48 and 50.

In accordance with the preferred embodiment of this invention the panel sections are supported and held in place by vertical supports. The interaction of the panels and vertical supports is described in great detail in the above referred in copending application Ser. No. 801,304. While the use of vertical supports to support the panel section is the preferred embodiment it should be noted that the panel sections can be hinged directly to each other without the need for vertical supports. Directly hinged panels are illustrated in U.S. Pat. Nos. 3,695,330 and 4,163,303.

As was mentioned above header section 6 consist of two panels 28 and 30 the edges of which are supported by edge sections 52,54,56 and 58 which are identical to the vertical supports as are described herein above. For cosmetic reasons it is desirable that header section 6 present the same optical impression as base section 4, however, it is understood that the construction and optical appearance of base section 4 and header section 6 can vary and still achieve the reinforced structure of this invention.

Panel devices which consist of a plurality of individual panel sections which are pivotly connected to each other are common in the prior art. Exemplary prior art structures are generally illustrated in U.S. Pat. Nos. 4,194,313 and 3,501,800. These prior art structures are disadvantageous in that they are unstable in that the respective panel sections can move in relation to each other. Further these prior art structures have shortcomings in that they do not incorporate header sections. Headers are desirable in that they add another dimension to the panel device and they add surface area to the panel device. This added surface area is desirable when the panel device is being used as a portable display as additional display surface is provided.

When the panel device is used in the furniture arts the additional dimension is desirable as the header functions as a noise barrier.

In addition to the advantages as described above the header is particularly advantageous when used in the structure of this invention as the header locks up the panel sections of the base section into a rigid, stable structure.

A reinforced panel device in accordance with this invention is achieved by the cooperation of header section 6 with base section 4. As can be seen in FIG. 1 base section 4 is free standing because sections 8 and 14 are angularly disposed to the planar surface which consist of section 10 and 12. To understand the reinforcement which is achieved in accordance with this invention one must picture base section 4 without header section 6. Regardless of the fact that base section 4 is free standing, in the absence of header section 6 panel sections 8,10,12 and 14 are free to pivot about the respective hinges which pivotly secure these panel sections together. That is if a slight pressure is applied to any given panel this panel is free to pivot relative to the adjacent panel section to which it is attached. This slight movement tends to give the composite structure an unstable appearance. In the absence of a header section the base section is deficient as a panel device in that the individual panel sections are free to move in relation to each other. In contrast to these problems when a header section is added to the base section in accordance with the illustration of FIG. 1 the individual panel section which make up base section 4 are locked into relationship with each other. When panel section 10 and 12 are locked into relationship with each other the overall panel device 2 takes on an air of stability. This stability is readily evident to a user of panel device 2 as for example if a user were to post are work on panel 12 he would find that base section 4 is stable because of the presence of header section 6. In the absence of header section 6 if a user attempted to post art work on panel sections 12 he would immediately discern the movement of panel section 12 in relation to panel section 10.

The individual panel section of a base section are locked up, by the placement of a header section on the upper edge of the base section, because the possible plane of movement of the panel sections of the header is different from that of the panel sections of the base.

Figure 4:
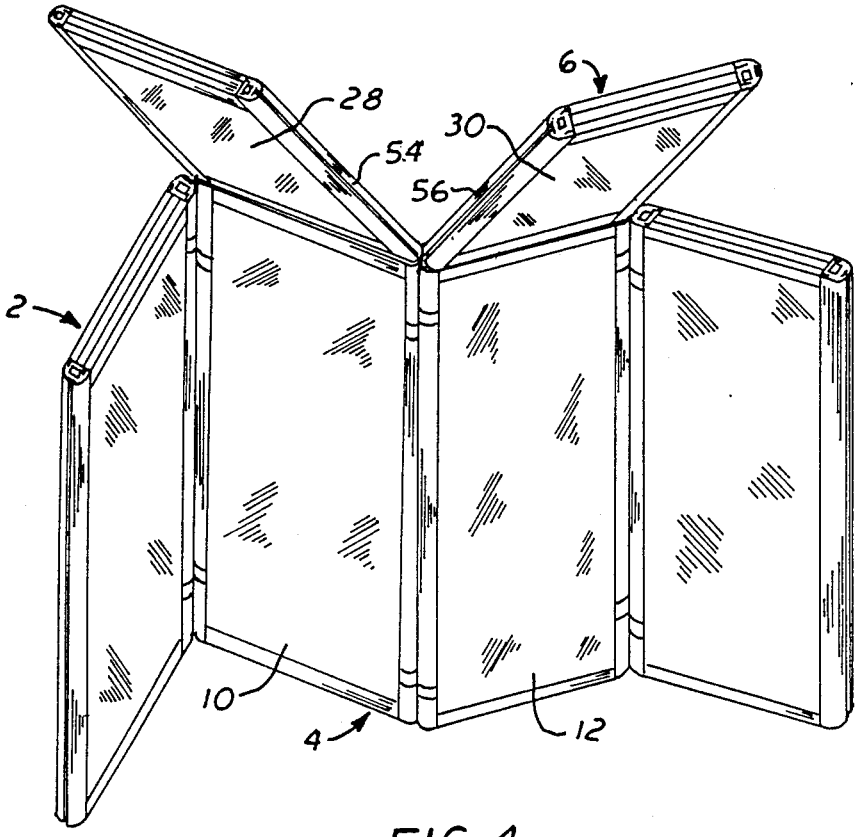
FIG. 4 illustrates a non operative mode of the subject inventor for explanation.

This lock up is further illustrated in FIG. 4 which shows the panel device 2 of FIG. 1 in an unlocked configuration. In FIG. 4 for the sake of illustration panel sections 28 and 30 of header 6 are not pivotly connected to each other. In this illustration panel sections 10 and 12 of base 4 are angularly disposed to each other. Because of this angular placement of panel sections 28 and 30 of header 6 are pulled apart at an angle, along the meeting line of vertical supports 54 and 56. It can be seen that if vertical supports 54 and 56 are pulled together in an abutting relationship panel sections 28 and 30 become planar and likewise panel sections 10 and 12 become planar. Because of the angular relationship of header 6 with base 4 when panel sections 28 and 30 are in abutting relationship panel sections 10 and 12 are locked into planar relationship with each other.

In accordance with the preferred embodiment the panel sections of the header are pivotly connected to each other. This pivotal connection is desirable as when the header is removed from the base its panel sections can be folded one upon each other in order to allow compact storage and easy shipment. While header sections having panel sections pivotly attached are illustrated it is understood that the header could consist of a single panel section which is long enough to bridge one or more of the seams where the panel sections of the base are pivotly attached to each other.

The header may be attached to the upper extremity of the base by any convenient method. The header may be permanently or semi-permanently attached to the base. In accordance with the preferred embodiment the header is attached to the base by a quick detachment means. The ability to quickly attach and detach the header from the base is highly desirable when the subject reinforced panel device is used as a portable display. The ability to quickly attach and remove the header from the base allows one to quickly set up and tear down a portable display at a trade show.

Figure 2:
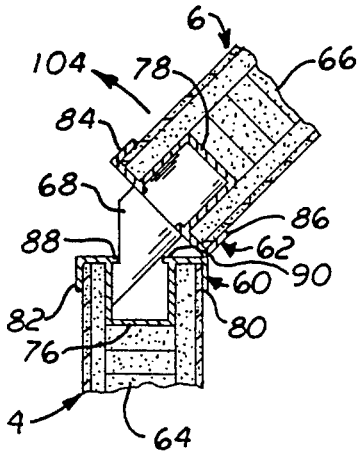
FIG. 2 is a section view through line 2—2 of FIG. 1 showing the preferred means for the attachment of the header section to the base section.

In accordance with the preferred embodiment the panel sections of the composite display are supported on their outer edge by vertical supports which define the outer edge of the panel section. The vertical edge of the panel sections are generally defined by these supports. The horizontal edges of the panel sections in the preferred embodiment are defined by horizontal supports. FIG. 2 illustrates a preferred structure wherein horizontal supports 60 and 62 are used to enclose the horizontal edges of panels 64 and 66. The method whereby both the horizontal and vertical supports cooperate with each other and with the panels is described on great detail in copending application Ser. No. 801,304 which is incorporated herein by reference. In FIG. 2 it can be seen that header 6 is attached to base 4 via a connector plug 68 which engages horizontal supports 60 and 62.

Figure 3:
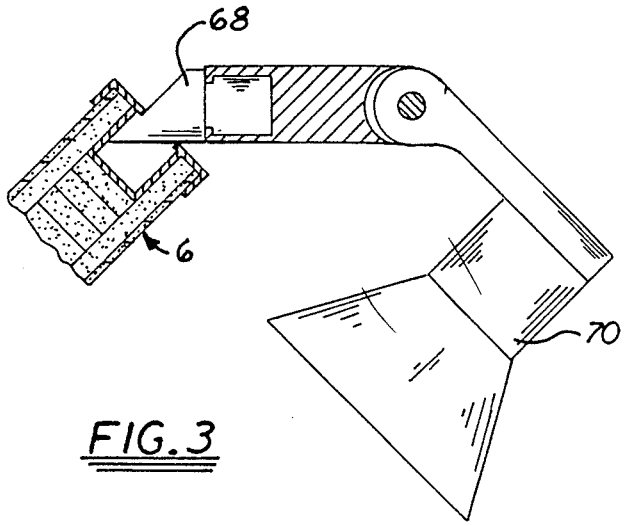
FIG. 3 illustrates other uses for the preferred attachment means as is illustrated in FIG. 2.

FIG. 3 illustrates that connector plug 68 has many uses in that for example it can be used to attach a lamp 70 to the upper edge of header 6.

Figure 5:
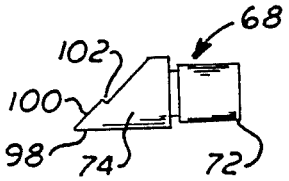
FIG. 5 is a side view of a connector plug which is useful in this invention.
Figure 6:
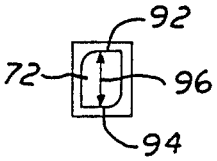
FIG. 6 is an end view of the connector plug of FIG. 5.

From FIGS. 2,5 and 6 it can be seen that connector plug 68 incorporates a camming end 72 and a channel engaging end 74.

As is illustrated in FIG. 2 horizontal supports 60 and 62 incorporate central U shaped channels 76 and 78 and outboard U shaped channels 80,82,84 and 86. These outboard U shaped channels are adapted to engage the outer edges of panels 64 and 66. Again the cooperation of panels such as panels 64 and 66 with U-shaped channels is described in great detail in the above referenced copending application Ser. No. 801,304. Horizontal supports further incorporate lips 88 and 90.

In FIG. 5 it can further be seen in detail that connector plug 68 has a camming end 72 and a hook end 74. The details of camming end 72 are further illustrated in FIG. 6 wherein it can be seen that camming end 72 incorporates two camming surfaces 92 and 94. The distance between the edges of camming surface 72 as is defined by arrow 96 is slightly greater than the distance across central U shaped channel 78 as is illustrated in FIG. 2. When camming end 72 of connector plug 68 is placed into central U shaped channel 78 and rotated in a clockwise direction connector plug 68 is locked into central U shaped channel 78. The radii of camming surfaces 92 and 94 are set up for rotation in a clockwise direction. It is understood by one skilled in the art that radii could be opposite and hence set up for counter-clockwise lock up.

As was mentioned above the distance between the respective camming surfaces of camming end 72, as is illustrated by arrow 96 is slightly greater than the distance between the inner edges of the U shaped channel into which it is to be locked. In accordance with the preferred embodiment of this invention connector plug 68 is formed from a hard thermoplastic material such as a nylon. When connector plug 68 is formed from a thermoplastic material the distance between the edges of the camming surface should exceed the distance across the U shaped channel by about 0.002 to about 0.005 inches. It is understood by one skilled in the art that the amount by which the overall width of connector plug 68 exceeds the width of the U shaped channel depends on the material from which the connector plug is formed and the structural integrity of the U shaped channel.

Hook end 74 of connector plug 68 further incorporate a straight edge 98 and an angle edge 100 which includes a hook 102. Straight edge 98 is generally parallel with the axis of connector plug 68. Angle edge 100 can be any convenient angle in relation to the axis of connector plug 68 which permits the proper angular placement of header 6 on base 4 as is illustrated in FIG. 1. In accordance with the preferred aspects of this invention angle edge 100 should be of such an angle, in relation to the axis of connector plug 68, such that header 6 is disposed on base 4 at an angle of between 30 and 45 degrees in relation to the planar relationship of the panel sections which make up base 4.

As is illustrated in FIG. 5 angle edge 100 of connector plug 68 incorporates a hook 102. As is shown in FIG. 2 hook 102 is adapted to engage lip 88 or horizontal support 60. As a result of this engagement header 6 is secured into horizontal support 60 and hence the positioning of header 6 in relation to base 4 is secured. When header 6 is moved in the direction of arrow 104 hook 102 disengages lip 88 and hence header 6 can be lifted upward and out of contact with base 6. By use of this preferred attachment means header 6 can be easily and quickly attached and detached from base 4. If the composite structure is used as a portable display header 6 can be easily attached to base 4 with minimal effort at the start of a trade show. Conversely, take down can be effected easily at the end of a trade show.

From the above description it is evident that the outer edges of the panels sections which make up the panel sections of the base are defined by vertical supports. Similar supports also define the edges of the panel sections which may make up the header. For purposes of this application the supports which may define the edges of the panel sections which may make up both the base and header are defined as vertical supports.

From the above description and from FIGS. 1 to 6 it can be seen that the subject invention can be used to produce a wide variety of reinforced panel devices. It is understood by one skilled in the art that this invention is not limited to the embodiments as described and illustrated above.

What is claimed is:

1. A reinforced panel device comprising a base having a plurality of panel sections which are pivotly connected to each other in a planar relationship, which are stabalized by a rectangular header which is detachably attached to the upper edge of the said base wherein said header is angularly disposed to the plane of said base and bridges at least one pivot joint of the base in order to prevent the pivoted movement of the panels of said base.

2. The reinforced panel device of claim 1 wherein the panel sections are supported by vertical supports.

3. The reinforced panel device of claim 2 wherein non adjacent pairs of vertical supports are further secured to each other by horizontal supports.

4. The reinforced panel device of claim 1 wherein the header comprises a plurality of rectangular panel sections which are pivotly connected to each other.

5. The reinforced panel device of claim 2 wherein the header comprises a plurality of rectangular panel sections which are pivotly connected to each other.

6. The reinforced panel device of claim 1 wherein the panel sections of the base are attached to each other by mechanical hinges and the panel sections consist of panels and vertical supports which are attached to each other.

7. The reinforced panel device of claim 4 wherein the panel sections of the base and header are attached to each other by mechanical hinges and the panel sections consist of panels and vertical supports which are attached to each other.

8. The reinforced panel device of claim 5 wherein the panel sections of the base and header section are attached to each other by mechanical hinges and the panel sections consist of panels and vertical supports which are attached to each other.

9. The reinforced panel device of claim 6 wherein the panel sections of the base consist of vertical supports having integral attaching means for securing the panels.

10. The reinforced panel device of claim 3 wherein the panel sections of the base consist of vertical supports having integral attaching means for securing the panels.

11. The reinforced panel device of claim 7 wherein the panel sections of the base and header consist of vertical supports having integral attaching means for securing the panels.

12. The reinforced panel device of claim 8 wherein the panel sections of the base and header consist of vertical supports having integral attaching means for securing the panels.

13. The reinforced panel device of claim 10 wherein upper and lower horizontal supports are utilized and at least the upper horizontal support incorporates an integral attaching means which is adapted to receive a connector whereby the header is attached to the base.

14. The reinforced panel device of claim 13 wherein at least the upper horizontal support incorporates a U shaped channel having opposing lips which are adapted to receive and secure said connector.

* * * * *